US005498852A

United States Patent [19]

Cress

[11] Patent Number: 5,498,852

[45] Date of Patent: Mar. 12, 1996

[54] OVAL TOP LOADING KILN HAVING REMOVABLE SHELVES

[76] Inventor: Steven B. Cress, 31 Lakefront Dr. - Box 30, Glenbrook, Nev. 89413

[21] Appl. No.: 209,861

[22] Filed: Mar. 7, 1994

[51] Int. Cl.[6] ..... F27B 9/00

[52] U.S. Cl. ..... 219/390; 219/406; 219/407; 432/120; 432/258; 110/349; 373/109; 108/110

[58] Field of Search ..... 219/406, 407, 219/390; 108/157, 148, 110; 432/120, 258, 253; 110/336, 349; 373/137, 109

[56] References Cited

U.S. PATENT DOCUMENTS

| | | | |
|---|---|---|---|
| 1,056,933 | 3/1913 | Perkins | 219/407 |
| 1,581,259 | 4/1926 | Wiechert | 219/407 |
| 1,663,744 | 3/1928 | Ziola | 219/406 |
| 1,692,547 | 11/1928 | Evans | 219/407 |
| 4,215,265 | 7/1980 | White | 219/390 |
| 4,272,670 | 6/1981 | Docx | 219/390 |
| 5,378,144 | 1/1995 | Cress | 432/120 |

*Primary Examiner*—John A. Jeffery
*Attorney, Agent, or Firm*—Herbert C. Schulze

[57] ABSTRACT

A kiln method and apparatus wherein a kiln chamber is formed of appropriate material, preferably having an oval cross-section with grooves in the narrower sides of the oval and oval shaped shelves which can be inserted into the oval chamber and turned so as to be supported within said grooves, and heat producing apparatus exterior of said chamber surrounded in turn by appropriate insulating material, resulting in a kiln having the mechanical structure of an endo skeleton supporting heating elements, shelves, lid, insulation, temperature control apparatus, and the like.

4 Claims, 2 Drawing Sheets

Fig. 3.
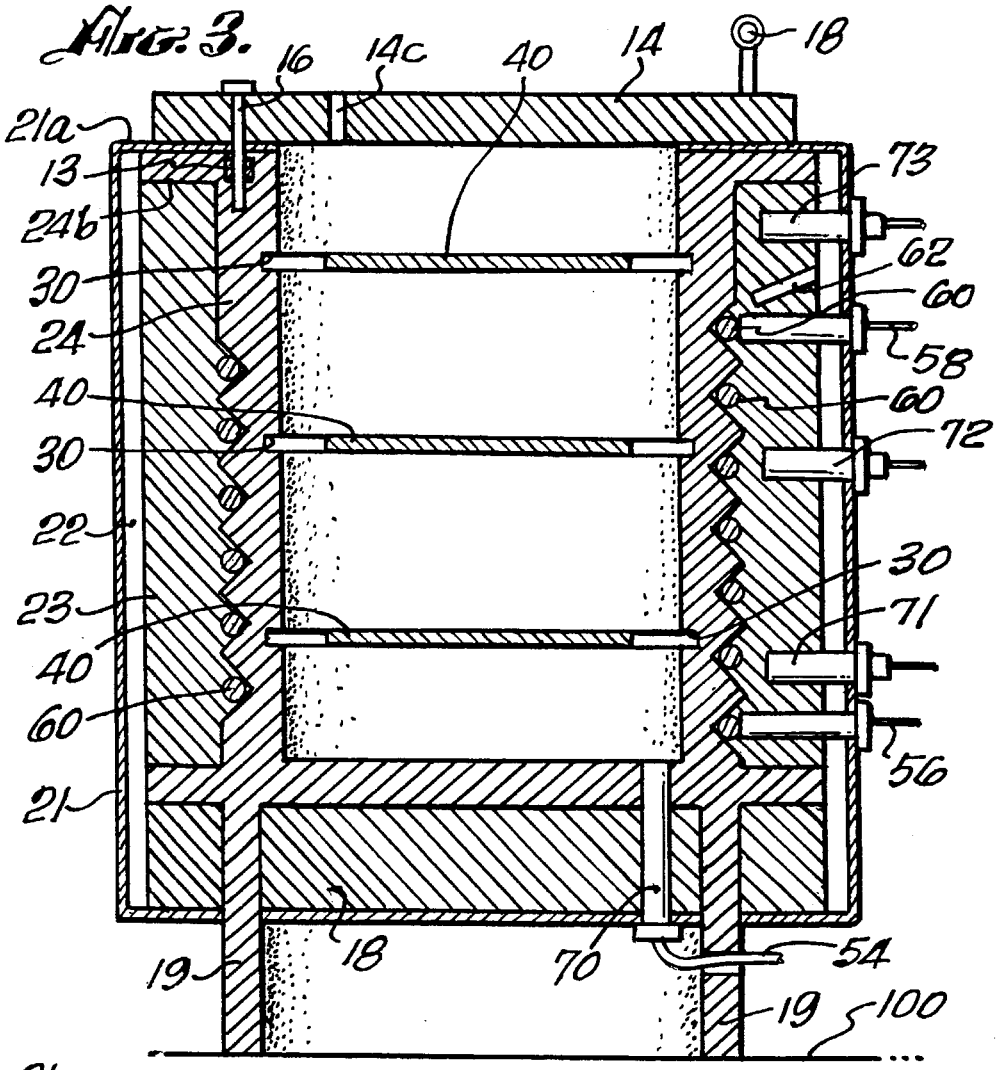
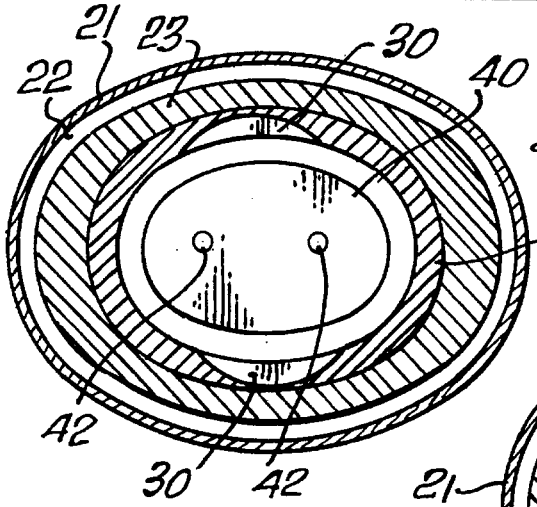
Fig. 4.
Fig. 5.
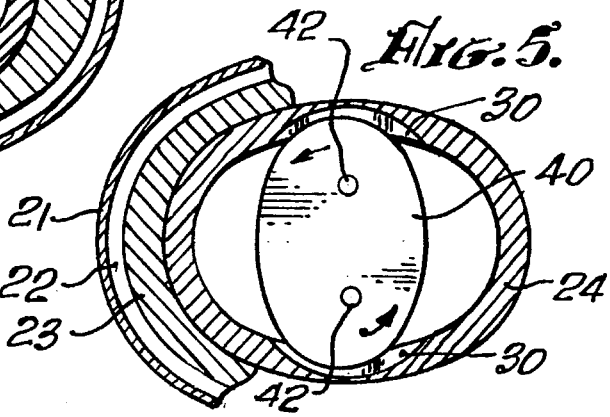

OVAL TOP LOADING KILN HAVING REMOVABLE SHELVES

CROSS REFERENCE TO RELATED PATENT APPLICATIONS

This application is not related to any other application filed by me except that it is in the general field of ceramic kilns and the like to which my presently co-pending applications for Method and Apparatus for Temperature Uniformity and Repeatable Temperature and Location Specific Emission Control of Kilns, Ser. No. 07/844,468, filed Mar. 2, 1992, now U.S. Pat. No. 5,378,144, and Ser. No. 08/121, 181, filed Sep. 19, 1993, now abandoned, relate.

BACKGROUND OF THE INVENTION

I. Field of the Invention

This invention is in the general field of kilns and the like, the invention is even more particularly directed to a unique kiln structure embodying what I refer to as an Endo Skeleton (or Skeletal) structure wherein the insulation and heating means are completely exterior of the kiln chamber and wherein a unique structure provides for elimination of interior kiln furniture and for unique arrangements providing a multiplicity of firing zones operating at independent temperatures within a single chamber.

II. Description of the Prior Art

There are many types of kilns and the like for the firing/curing of ceramic and other products. Such kilns generally consist of a structure of insulating material such as ceramic bricks or fibers, or the like, around a chamber with arrangements for heating within the chamber. Within the chamber there is generally what is referred to as "Kiln Furniture" which is well known to those skilled in the art, and generally consists of ceramic, or the like, structures supporting the various shelves and the like, upon which items being treated within the kiln are supported.

My present invention is different from the previously known structures in that it comprises a ceramic chamber having an oval cross-section with interior grooves such that oval shelves may be inserted into the oval chamber and turned to provide shelves upon which greenware placed into the kiln may be supported. Heating means is provided exterior of the chamber, with insulation means exterior of the heating means.

SUMMARY OF THE INVENTION

There are large numbers of commercial and hobbyist ceramic kilns, and the like, in use throughout the United States and other countries of the world. Many more kilns come into use on a regular basis.

Such kilns and the like uniformly consist of a chamber formed by appropriate insulating material, as is known to those skilled in the art, with means to provide heat within the chamber.

Within the chamber various posts and the like will support shelves, which, in turn, are used to support the ceramic ware and the like being subjected to the heating process. The items which support the ceramic ware being subjected to the heating process is known as "Kiln Furniture".

In the customary kiln the products which may be emitted by the heating means, such as gases and the like, may contaminate the material being cured. Also, some of the insulation may flake off and further contaminate articles being cured. Additionally, if unexpected vibration takes place, the kiln furniture can collapse. Further, with a single curing zone it is difficult to control different temperatures so as to create more than one zone of temperature within the same chamber. This has been partially addressed by my co-pending patent applications referred to above, but the present invention is a more reliable means for accomplishing this desired result.

I have now developed a kiln method and apparatus which provides excellent curing of ceramic greenware and the like.

My invention comprises the formation and use of an oval shaped ceramic curing chamber having grooves, as are described in more detail in the description of a preferred embodiment which follows, and oval shelves, which can be inserted without other supporting kiln furniture. Heating means are provided exterior of the curing chamber. Insulating means are provided exterior of the heating means. An air chamber is provided exterior of the insulation means, with a final exterior skin surrounding the entire device.

It is an object of this invention to provide a kiln in which the heating means is exterior of the curing chamber;

Another object of this invention is to provide a kiln as described wherein the need for kiln furniture is eliminated;

Another object of this invention is to provide a kiln as described wherein all insulation is isolated from the curing chamber of the kiln.

The foregoing and other objects and advantages of this invention will be apparent to those skilled in the art upon reading the description of a preferred embodiment, which follows, in conjunction with reference to the appended drawings.

BRIEF DESCRIPTION OF THE DRAWINGS

FIG. 3 is an enlarged section on 3—3 of FIG. 1;

FIG. 4 is a schematic horizontal section in reduced scale showing a shelf being inserted; and FIG. 5 is the same as FIG. 4 but showing the shelf being held in the device.

DESCRIPTION OF A PREFERRED EMBODIMENT

Figure 1:
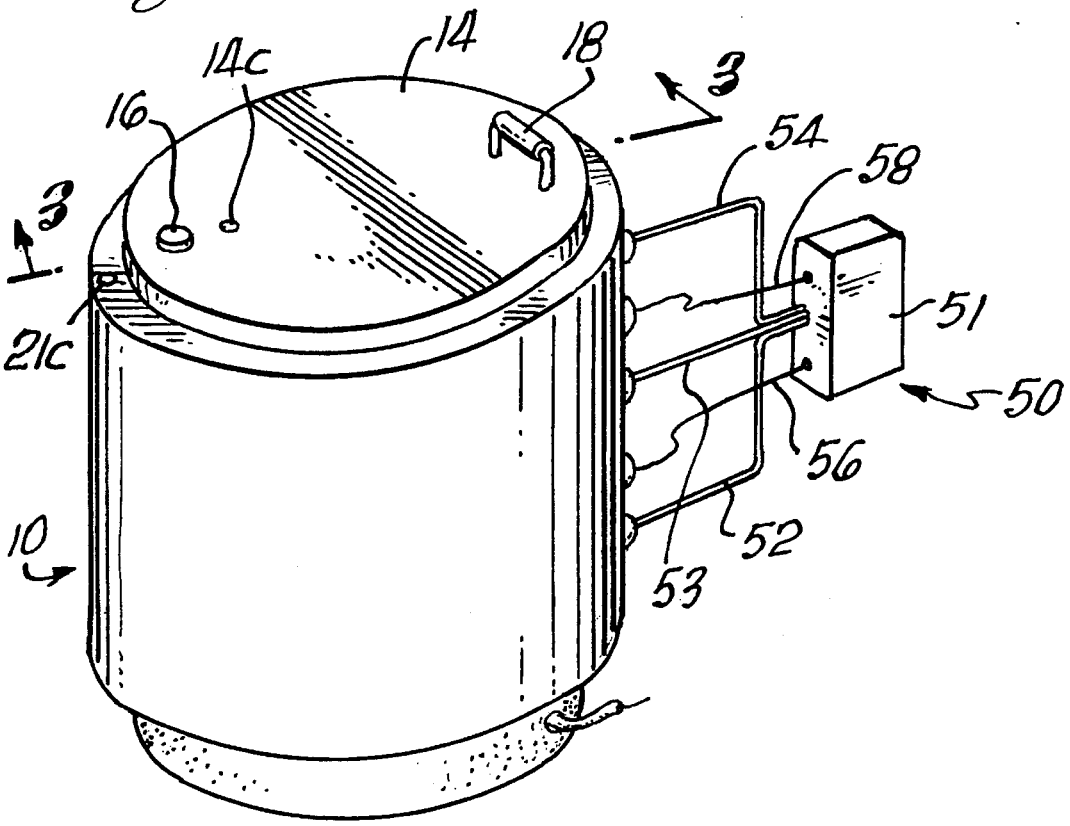
FIG. 1 is a perspective of a device suitable to practice the method of this invention.

The Figures illustrate a kiln, 10, according to this invention. The kiln is supported on integrally formed oval extension 19. As shown in FIG. 3, the support portion 19 will rest on a surface, such as floor, or the like, 100.

The kiln has a cover 14, formed of ceramic material such as the material of which the curing chamber is formed (brick, rigid kaowool, or other suitable material), which can pivot about pivot pin 16. The cover is provided with a handle 18. A vent hole 14*c* is provided in the cover. A control box, or panel, 51 will contain the customary kiln controls, which are known to those skilled in the art. Leads 52, 53, and 54 will run from piezo crystals or other suitable temperature controls located in the kiln and shown in FIG. 3, the details of which are known to those skilled in the art.

A pair of electrical leads 56 and 58 are shown. It is to be understood that these leads will supply power to heating elements which are shown in FIG. 3. It is clear that other heating means such as gas or the like my be used. It is probable that with electrical heating three phase power will be used. The exact heating can be accomplished in different ways known to those skilled in the art.

Figure 2:
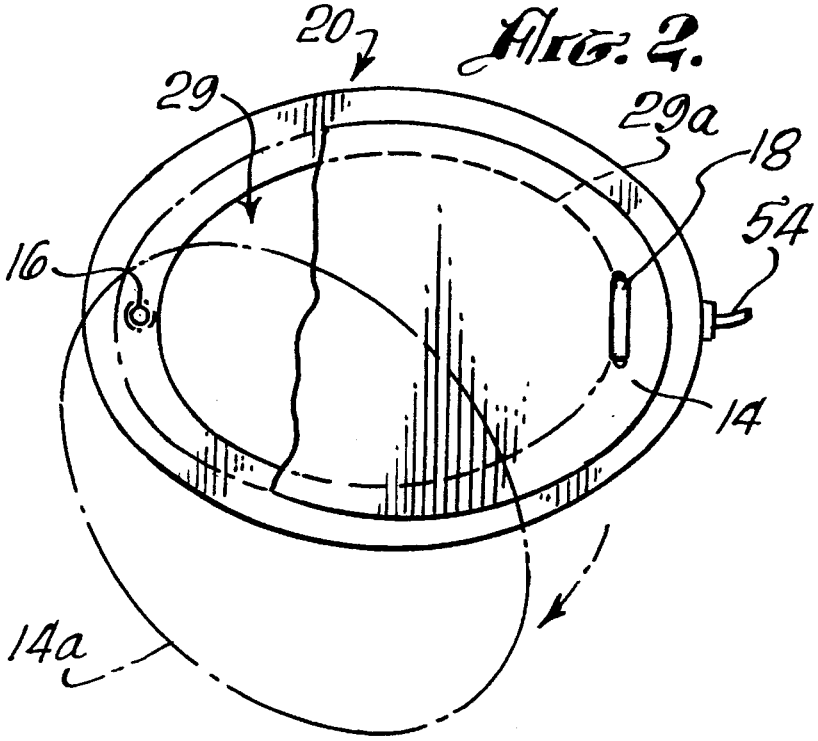
FIG. 2 is a top elevation on FIG. 1 with the cover removed and a showing, in phantom outline, the cover partially opened.

FIG. 2 shows the curing chamber 29 with a phantom outline of the chamber 29a under the cover 14. The phantom 14a is the cover being opened.

FIG. 3 is an enlarged section of the kiln. A ceramic or other high temperature resisting material 24 forms an oval cylinder having an integral closed bottom with an extending flange as illustrated, a top shoulder 24b, and integral support structure 19. A major advantage of this structure is that inexpensive insulating material such as fire brick, kaowool, or other suitable material 23 forms an insulating structure about the curing chamber. Inexpensive insulating material cannot be used in the customary kilns since it will flake off, give off fumes, and otherwise cause contamination of the material being cured in the kiln. Similar insulating material 18 insulates beneath the curing chamber.

Heating elements 60 surround the curing chamber as shown. The heating elements may be electrical, as shown here, or they may be gas or the like. The details of the various means for heating are known to those skilled in the art.

A unique feature of the heating in this kiln is that by non-uniform spacing of the elements in a spiralling manner about the circumference and over the height of the chamber, different heat zones can be established. Thus there could be as many as four different heat zones in the kiln illustrated. Each heat zone will be controlled by a suitable temperature control elements. I have illustrated one acoustic piezo crystal, or the like, 70. The use of acoustic piezo crystals to control the temperature in a kiln is believed to be a very unique feature of this new method and apparatus. Additionally, I have shown appropriate temperature control elements 71, 72, and 73. Any or all of these elements could be acoustic piezo crystals.

Three shelves, 40 are shown. The shelves may be provided with holes 42 to allow for even heat distribution, if wanted. The same holes may be used to handle the shelves in inserting them into the curing chamber. The shelves are oval in shape and are inserted into the oval chamber and then turned so their longer ends are held in the grooves 30 in the narrower sides of the chamber, as shown in FIG. 5.

Using shelves in this manner, there is no requirement for kiln furniture. This has a material advantage in that the kiln furniture in an ordinary kiln absorbs a great deal of heat, requiring more, and longer, firing. Also, the kiln furniture is costly and sometime unstable.

The cover 14 carries a pivot pin 16 mounted in bearing 13 to allow for opening. The cover will have a vent hole 14c, which may be closed a plug or the like (not shown) as desired.

One or more vents 62 will allow the escape of gases into the space 22 surrounding the insulation. One or more vents 21c will allow the escape of gases from the space 22 between the insulation and the outer shell 21, which is formed of suitable material, such as stainless steel or the like. The top portion of the outer shell 21a extends to cover the upper shoulder 24b.

I have illustrated a kiln embodying the features of this invention utilizing an oval shape. It is to be understood that other shapes could be used. I do not intend to be limited to the oval shape. Triangular, octagonal, or other shapes could be used.

While the embodiments of this invention shown and described are fully capable of achieving the objects and advantages desired, it is to be understood that such embodiments are for purposes of illustration only and not for purposes of limitation.

I claim:

1. The method of constructing a kiln comprising: forming an elongated oval cylindrical kiln chamber, having a wall thickness, of material which will withstand higher temperatures than those which will be used in curing material placed within the chamber, and having a first end closed and a second end open; forming grooves within the narrow sides of the oval chamber on the interior thereof; providing heating means exterior of said chamber; providing oval shaped shelves suitable to be inserted into said chamber with the longer ends of said shelves in alignment with the longer interior dimensions of the oval chamber in such manner that the shelves may be turned so that their longer ends will be held within the grooves in the narrower sides of the interior of the oval chamber intermediate its first closed end and its second open end; and providing insulation means exterior said heating means.

2. A kiln comprising: an oval elongated cylindrical kiln chamber formed of material which will withstand higher temperatures than those which will be used in curing material within said chamber, having a first end closed and a second end open, with slots within the narrower sides of the oval chamber on the interior thereof; at least one oval shaped shelf suitable to be inserted into said chamber in such manner that the shelf may be turned so that the longer ends of the shelf fit into said slots so that the shelf is held in position intermediate the first closed end and the second open end of said chamber; heating means exterior of said chamber; and insulation means exterior of the heating means.

3. The kiln of claim 2 wherein acoustical piezo crystals are used to sense and control the temperature within the chamber.

4. The kiln of claim 3 wherein an outer shield surrounds the kiln at a spaced distance from the insulation material.

* * * * *